US007821193B2

(12) United States Patent
Wei et al.

(10) Patent No.: US 7,821,193 B2
(45) Date of Patent: Oct. 26, 2010

(54) COLOR PIXEL ELEMENT FOR FIELD EMISSION DISPLAY

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 371 days.

(21) Appl. No.: 12/069,313

(22) Filed: Feb. 8, 2008

(65) Prior Publication Data

US 2009/0134773 A1 May 28, 2009

(30) Foreign Application Priority Data

Nov. 23, 2007 (CN) ..... 2007 1 0124775

(51) Int. Cl.
*H01J 1/62* (2006.01)

(52) U.S. Cl. ..... 313/496; 313/336; 977/163

(58) Field of Classification Search ..... 313/495–197, 313/294, 306, 309–311, 351, 346 R, 336; 977/163, 79

See application file for complete search history.

(56) References Cited

U.S. PATENT DOCUMENTS

| | | | | |
|---|---|---|---|---|
| 4,818,914 | A | 4/1989 | Brodie | |
| 6,794,814 | B2 * | 9/2004 | Lee et al. | 313/496 |
| 7,525,244 | B2 * | 4/2009 | Chung et al. | 313/491 |
| 7,615,919 | B2 * | 11/2009 | Yang et al. | 313/496 |
| 2003/0090190 | A1 * | 5/2003 | Takai et al. | 313/311 |
| 2003/0143356 | A1 | 7/2003 | Morikawa | |
| 2005/0035701 | A1 | 2/2005 | Choi et al. | |
| 2005/0046335 | A1 | 3/2005 | Chen et al. | |
| 2005/0236961 | A1 | 10/2005 | Wei et al. | |
| 2005/0280348 | A1 * | 12/2005 | Chan et al. | 313/495 |
| 2007/0096075 | A1 | 5/2007 | Li et al. | |

FOREIGN PATENT DOCUMENTS

| | | |
|---|---|---|
| CN | 1420518 | 5/2003 |
| CN | 2731902 Y | 10/2005 |
| CN | 1691267 | 11/2005 |
| CN | 1779897 | 5/2006 |
| TW | I260669 | 8/2006 |
| TW | I278887 | 4/2007 |
| TW | I281183 | 5/2007 |

* cited by examiner

*Primary Examiner*—Peter Macchiarolo
(74) *Attorney, Agent, or Firm*—Jeffrey T. Knapp

(57) ABSTRACT

A color pixel element for field emission display includes a sealed container having a light permeable portion, at least two anodes, a cathode, at least two phosphor layers formed on the end surfaces of the anodes, and at least two CNT strings electrically connected to and in contact with the cathode with the emission portions of the CNT strings suspending. The phosphor layers are opposite to the light permeable portion, and one emission portion is corresponding to one phosphor layer. In each CNT string, some of CNT bundles are taller than and project over the adjacent CNT bundles, and each of projecting CNT bundles functions as an electron emitter. The anodes, the cathode, the phosphor layers and the CNT strings are enclosed in the sealed container. The luminance of the color pixel element is enhanced at a relatively low voltage.

19 Claims, 6 Drawing Sheets

COLOR PIXEL ELEMENT FOR FIELD EMISSION DISPLAY

RELATED APPLICATIONS

This application is related to commonly-assigned, co-pending application: U.S. patent application Ser. No. 12/069,299, entitled "PIXEL TUBE FOR FIELD EMISSION DISPLAY", filed on Feb. 8, 2008 and U.S. patent application Ser. No. 12/069,300, entitled "COLOR FIELD EMISSION DISPLAY HAVING CARBON NANOTUBES", filed on Feb. 8, 2008. The disclosure of the respective above-identified application is incorporated herein by reference.

BACKGROUND

1. Field of the Invention

The invention relates to color pixel elements and, particularly, to a color pixel element for field emission display.

2. Discussion of Related Art

Field emission displays (FEDs) are based on emission of electrons in vacuum. Electrons are emitted from micron-sized tips in a strong electric field, and the electrons are accelerated and collide with a fluorescent material, and then the fluorescent material emits visible light. FEDs are thin, light weight, and provide high levels of brightness.

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for electron emitter in FED. Generally, a color pixel element of the FED includes a number of CNTs acting as electron emitters. However, single CNT is so tiny in size and then the controllability of the method of manufacturing is less than desired. Further, the luminous efficiency of the FED is low due to the shield effect caused by the adjacent CNTs.

What is needed, therefore, is a color pixel element for FED, which has high luminous efficiency and can be easily manufactured.

SUMMARY

A color pixel element for field emission display includes a sealed container, at least two anodes, a cathode, at least two phosphor layers, and at least two CNT strings. The sealed container has a light permeable portion. Each one of the at least two phosphor layers is formed on an end surface of a corresponding anode and spaced from the light permeable portion. The at least two CNT strings are electrically connected to and in contact with the cathode. Each one of the at least two CNT strings has an emission portion corresponding to one of the at least two phosphor layer. Each one of the at least two CNT strings comprises a plurality of CNT bundles. Some CNT bundles are named as projecting CNT bundles which are taller than and project over adjacent CNT bundles. Each of the projecting CNT bundles functions as an electron emitter. The cathode, the at least two anodes, the at least two phosphor layers and the at least two CNT strings are enclosed in the sealed container.

Compared with the conventional color pixel element, the present color pixel element has the following advantages: using CNT string as the electron emitter, and thus the color pixel element is more easily fabricated. Further, the emission portion of the CNT string is in a tooth-shape structure, which can prevent from the shield effect caused by the adjacent CNT bundles, and the luminous efficiency of the color pixel element is improved.

Other advantages and novel features of the present color pixel element will become more apparent from the following detailed description of preferred embodiments when taken in conjunction with the accompanying drawings.

BRIEF DESCRIPTION OF THE DRAWINGS

Many aspects of the present color pixel element can be better understood with reference to the following drawings. The components in the drawings are not necessarily to scale, the emphasis instead being placed upon clearly illustrating the principles of the present color pixel element.

Figure 1:
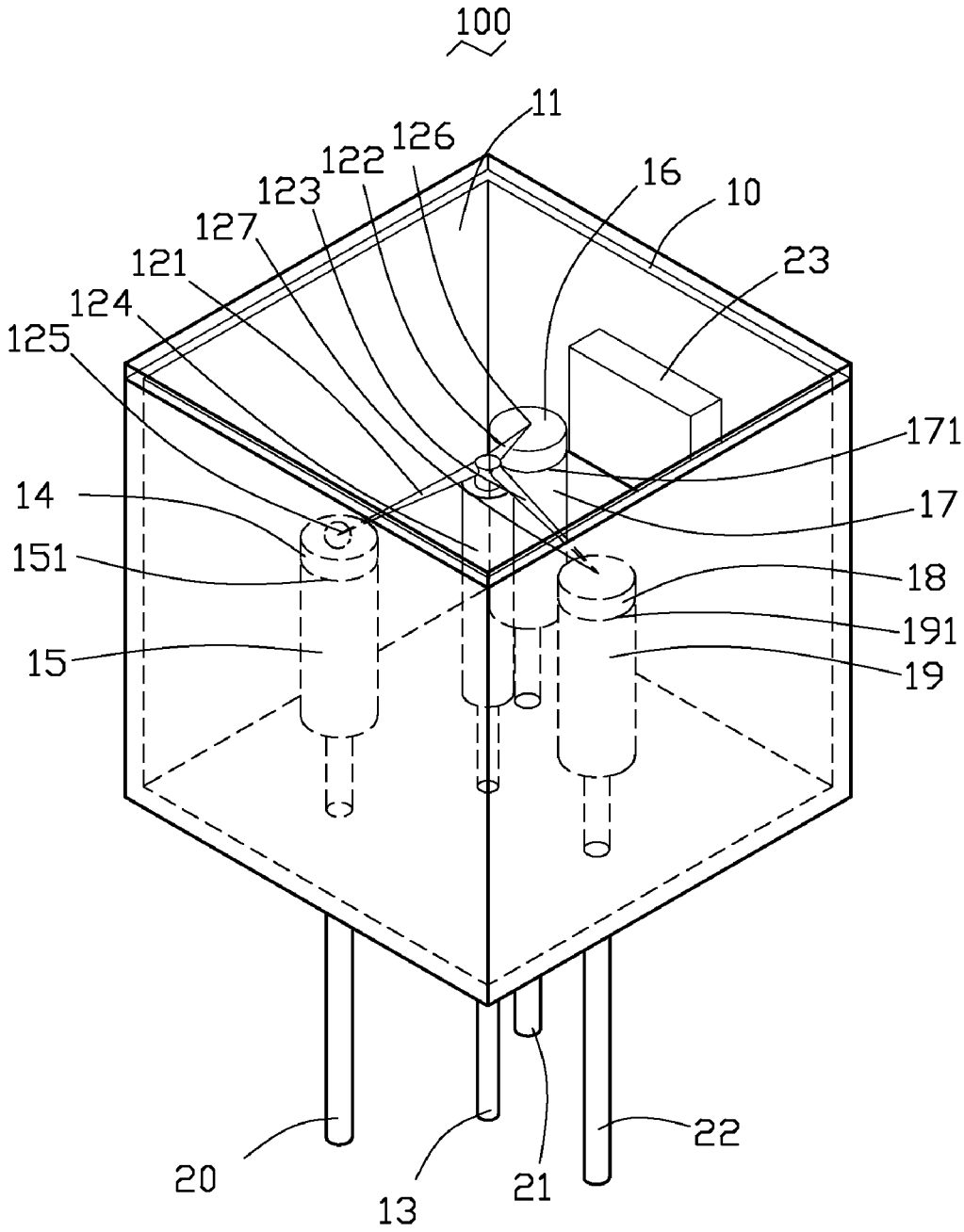
FIG. 1 is a schematic, isometric view of a color pixel element according to an embodiment.

Corresponding reference characters indicate corresponding parts throughout the several views. The exemplifications set out herein illustrate at least one preferred embodiment of the color pixel element, in one form, and such exemplifications are not to be construed as limiting the scope of the invention in any manner.

DETAILED DESCRIPTION OF PREFERRED EMBODIMENTS

Reference will now be made to the drawings to describe the preferred embodiments of the present color pixel element for a field emission display, in detail.

Figure 2:
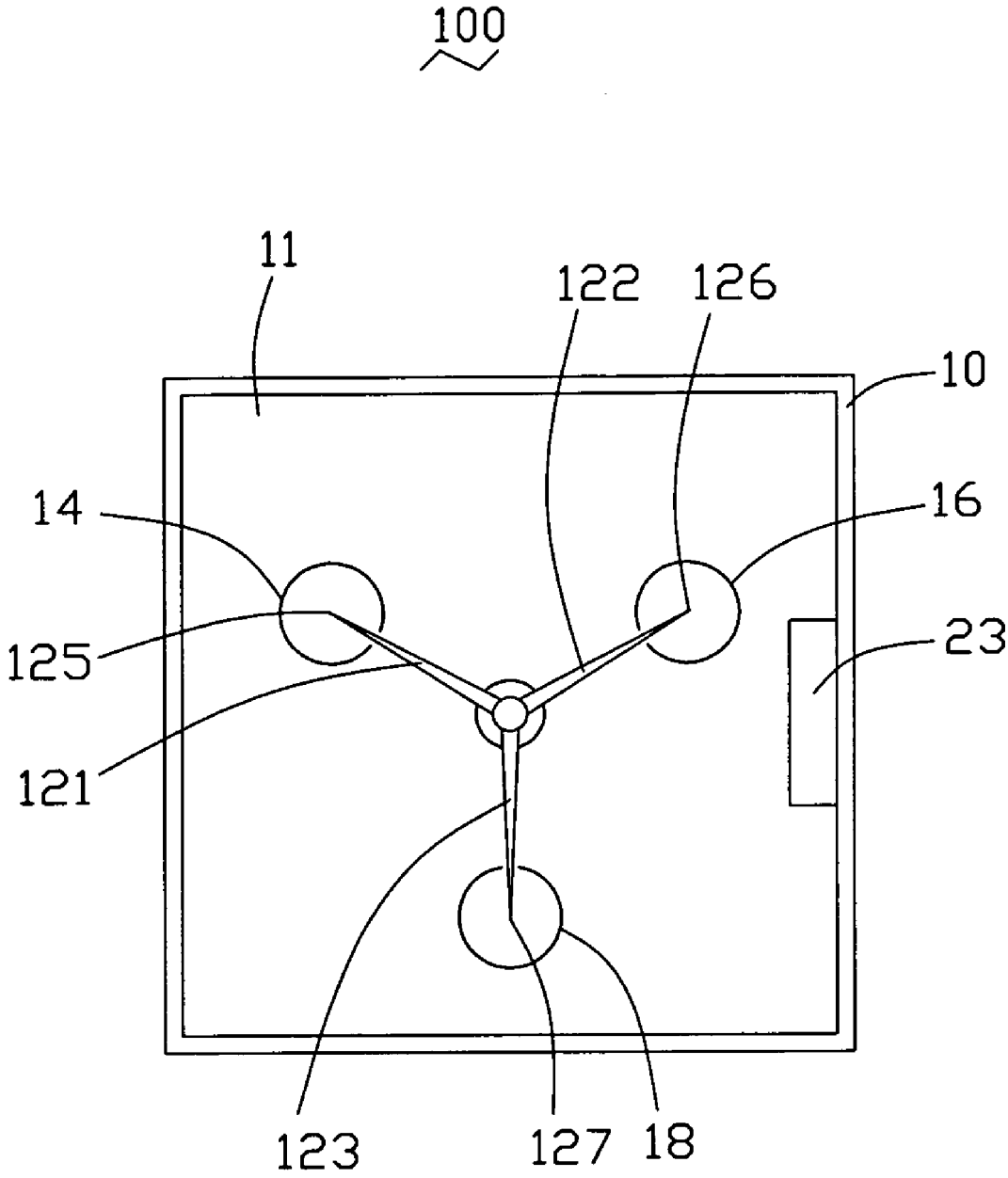
FIG. 2 is a schematic, top-sectional view of a color pixel element according to an embodiment.

Referring to FIGS. 1 and 2, a color pixel element 100 for a FED includes a sealed container 10 having a light permeable portion 11, a cathode 124, three CNT strings 121, 122 and 123, three anodes 15, 17 and 19, three phosphor layers 14, 16 and 18, a cathode terminal 13 and three anode terminals 20, 21 and 22. The cathode 124, the CNT strings 121, 122 and 123, the anodes 15, 17 and 19, and the phosphor layers 14, 16 and 18 are all enclosed in the sealed container 10. The cathode 124, the anodes 15, 17 and 19, the cathode terminal 13, and three anode terminals 20, 21 and 22 are made of thermally and electrically conductive materials.

The cathode 124 is electrically connected to the cathode terminal 13. The anode 15 is electrically connected to the anode terminal 20. The anode 17 is electrically connected to the anode terminal 21. The anode 19 is electrically connected to the anode terminal 22. The cathode terminal 124, and the anode terminals 20, 21 and 22 run from the inside to the outside of the sealed container 10.

The sealed container 10 is a hollow member that defines an inner space in vacuum. The cross section of the sealed container 10 has a shape selected from a group consisting of circular, ellipsoid, quadrangular, triangular, polygonal and so on. The sealed container 10 may be comprised of any non-metallic material, and the light permeable portion 11 need to be made of a transparent material. In the present embodiment, the sealed container 10 is a hollow cube made of quartz or glass. A side length of the sealed container 10 is in a range from about 2 millimeters (mm) to about 10 mm. The light permeable portion 11 has a surface selected from the group consisting of a plane surface, a spherical surface and an aspherical surface.

The anodes 15, 17 and 19 are made of metal materials. The distances between the cathode 124 and each one of the anodes 15, 17 and 19 are substantially equal. The distances between each two of the anodes 15, 17 and 19 are in a range from about 10 micrometers (μm) to about 2 mm. Further, the space among the anodes 15, 17 and 19 are beneficially equal. The anode 15 has an end surface 151, the anode 17 has an end surface 171, and the anode 19 has an end surface 191. The phosphor layers 14, 16 and 18 with a thickness from about 5 μm to about 50 μm, are formed on one of the corresponding end surfaces 151, 171 and 191. The phosphor layer 14 is a red phosphor layer, the phosphor layer 16 is a green phosphor layer and the phosphor layer 18 is a blue phosphor layer. The end surface 151, 171 and 191 are polished metal surfaces or plated metal surfaces, and thus can reflect the light beams emitted from the phosphor lays 14, 16 and 18 to the light permeable portion 11 to enhance the brightness of the color pixel element 100.

Figure 3:
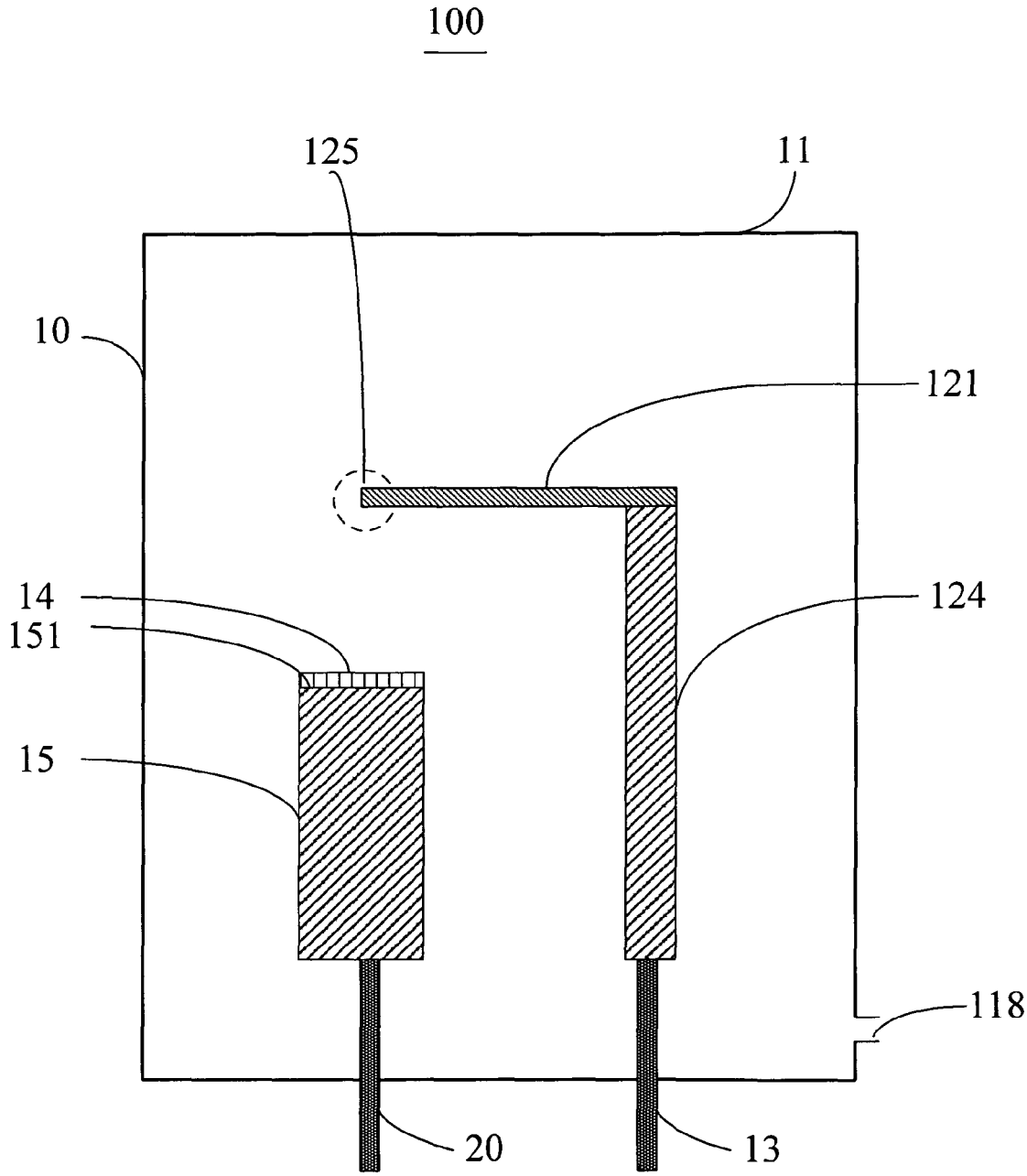
FIG. 3 is a schematic, side-sectional view of a part of the color pixel element according to an embodiment.

In the present embodiment, the three CNT strings 121, 122 and 123 have the same structures, and the three anodes 15, 17 and 19 have the same structures. Thus, the CNT string 121 and the anode 15 are described for an example as the following. Referring to FIG. 3, the CNT string 121 is electrically connected to and in contact with the cathode 124 by a conductive paste, such as silver paste, with an emission portion 125 of the CNT string 121 suspending. The phosphor layer 14 is opposite to the light permeable portion 11, and the emission portion 125 is corresponding to the phosphor layer 14. A distance between the emission portion 125 and the phosphor layer 14 is less than 5 mm. The emission portion 125 can be arranged perpendicular to the phosphor layer 14, parallel to phosphor layer 14 or inclined to phosphor layer 14 with a certain angle. In the present embodiment, the emission portion 125 is parallel to a surface of the phosphor layer 14 and a surface of the light permeable portion 11, and arranged between the phosphor layer 14 and the light permeable portion 11. The cathode 124 is made of an electrically conductive material, such as nickel, copper, tungsten, gold, molybdenum or platinum.

The CNT string 121 is composed of a number of closely packed CNT bundles. Each of the CNT bundles includes a number of CNTs substantially parallel to each other and joined by van der Waals attractive force. A diameter of the CNT string 121 is in a range from about 1 μm to about 100 μm, and a length thereof is in a range from about 0.1 centimeters (cm) to about 10 cm.

Figure 4:
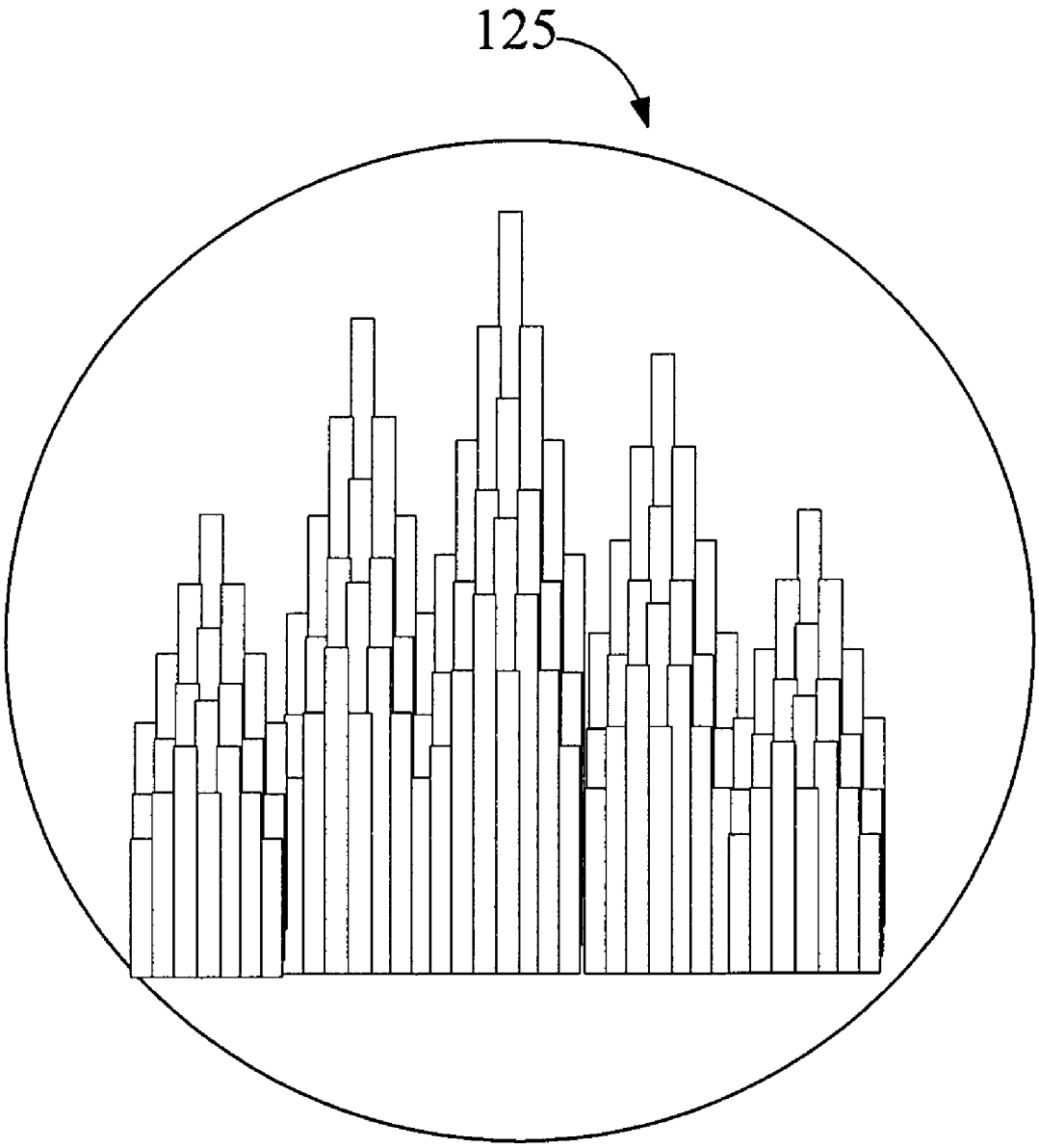
FIG. 4 is a schematic, amplificatory view of an emission portion of a CNT string in FIG. 1.
Figure 5:
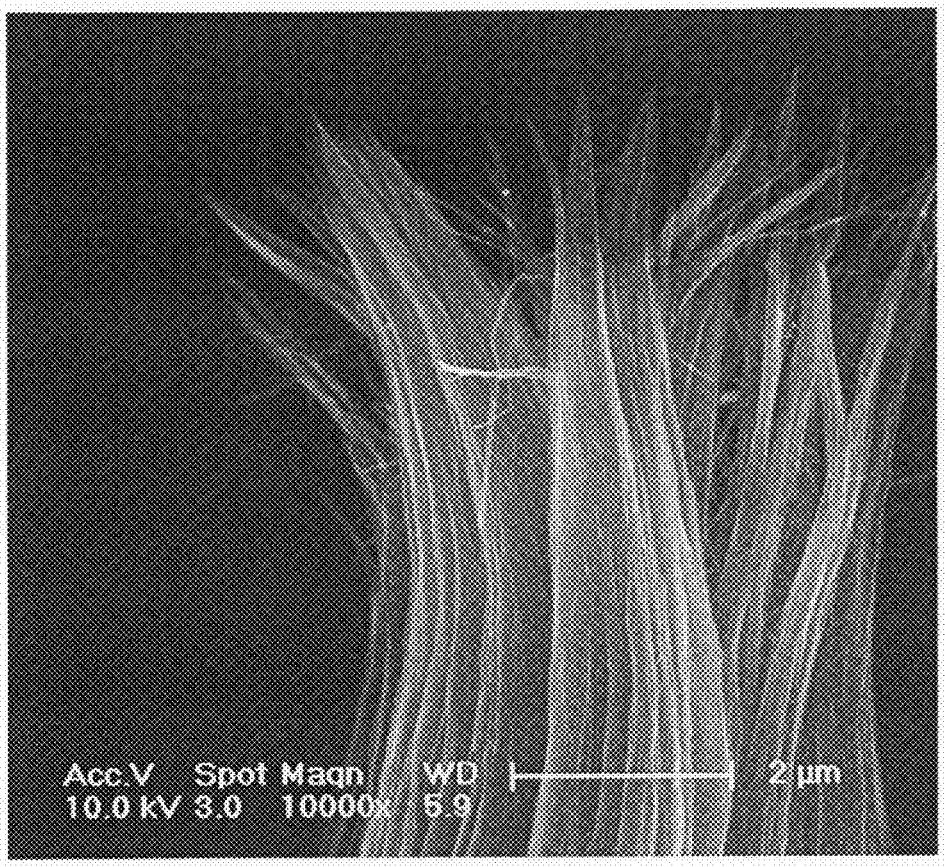
FIG. 5 is a Scanning Electron Microscope (SEM) photo, showing an emission portion of a CNT string in FIG. 1.
Figure 6:
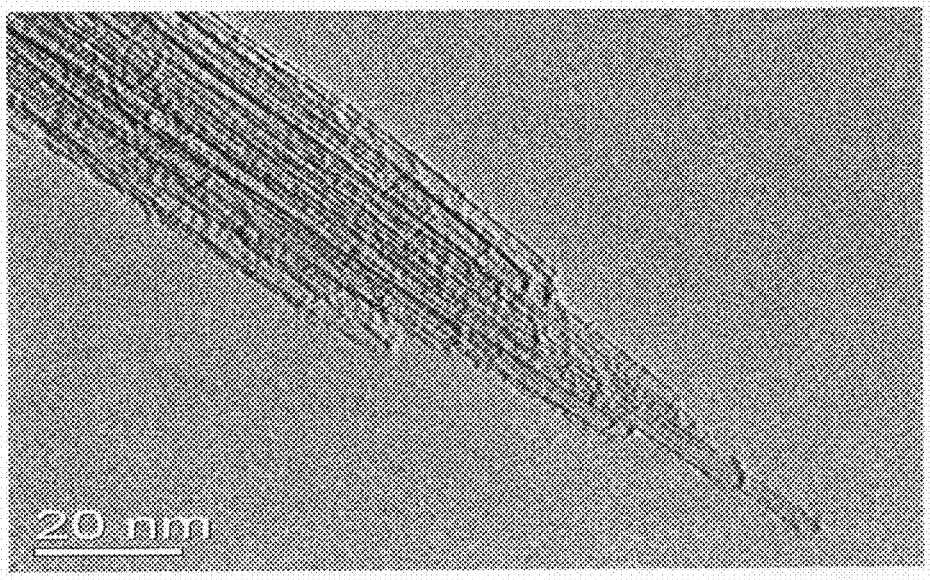
FIG. 6 is a Transmission Electron Microscope (TEM) photo, showing an emission portion of a CNT string in FIG. 1.

Referring to FIGS. 4, 5 and 6, the CNTs at the emission portion 125 form a tooth-shaped structure, i.e., some of CNT bundles being taller than and projecting above the adjacent CNT bundles. Therefore, a shield effect caused by the adjacent CNTs can be reduced. The field emission efficiency of the CNT string 121 is improved. The CNTs at the emission portion 125 have smaller diameter and fewer number of graphite layer. In the present embodiment, the CNTs at the emission portion 125 have a diameter less than 5 nanometer (nm). The number of graphite layers of the CNTs at the emission portion 125 is about 2. However, the CNTs in the portion of the CNT string 121 other than the emission portion 125 are about 15 nm in diameter and have more than 5 layers of graphite layer.

A method for making the CNT string 121 is taught in U.S. APPLICATION No. US16663 entitled "METHOD FOR MANUFACTURING FIELD EMISSION ELECTRON SOURCE HAVING CARBON NANOTUBES", which is incorporated herein by reference. The CNT string 121 can be formed by drawing a bundle of CNTs from a super-aligned CNT array to be held together by van der Waals force interactions. Then, the CNT string is soaked in an ethanol solvent, and thermally treated by supplying a current thereto. After the above processes, the CNT string 121 has improved electrical conducting and mechanical strength.

In operation, a voltage is applied between the cathode 124 and the anode 15, an electric field is formed therebetween, and electrons are emanated from the emission portion 125 of the CNT string 121. The electrons transmit toward the anode 15, hit the phosphor layer 14, and the visible red light beams are emitted from the phosphor layer 14. One part of the light beams transmits through the light permeable portion 11, another part is reflected by the end surface 151 and then transmits out of the light permeable portion 11. Using the CNT string 121, the luminance of the color pixel element 100 is enhanced at a relatively low voltage. By adjusting the voltages applied to the anodes 15, 17 and 19, the color pixel element 100 can emit any kinds of color light beam, such as white, yellow.

The color pixel element 100 may further includes a getter 23 configured for absorbing residual gas inside the sealed container 10 and maintaining the vacuum in the inner space of the sealed container 10. More preferably, the getter 23 is arranged on an inner surface of the sealed container 10. The getter 23 may be an evaporable getter introduced using high frequency heating. The getter 23 also can be a non-evaporable getter.

The color pixel element 100 may further includes an air vent 118. The air vent 118 can be connected with a gas removal system (not shown) such as, for example, a vacuum pump for creating a vacuum inside the sealed container 10. The color pixel element 100 is evacuated to obtain the vacuum by the gas removal system through the air vent 118, and then sealed. A number of color pixel elements 100 can be easily assembled into a large-area FED.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A color pixel element for field emission display, the color pixel element comprising:

a sealed container having a light permeable portion;

a cathode;

at least two anodes spaced from the light permeable portion;

at least two phosphor layers, wherein each one of the at least two phosphor layers is formed on an end surface of a corresponding anode and spaced from the light permeable portion; and at least two CNT strings electrically connected to and contacting the cathode, wherein each one of the at least two CNT strings has an emission portion corresponding to one of the at least two phosphor layer; each one of the at least two CNT strings comprises a plurality of first CNT bundles and a plurality of second CNT bundles, the plurality of second CNT bundles are taller than and project over the plurality of first CNT bundles, and each of the plurality of second CNT bundles functions as an electron emitter;

wherein the cathode, the at least two anodes, the at least two phosphor layers, and the at least two CNT strings are enclosed in the sealed container.

2. The color pixel element for field emission display as claimed in claim 1, wherein the emission portion of each one of the at least two CNT strings is arranged between the light permeable portion and a corresponding phosphor layer of the at least two phosphor layers.

3. The color pixel element for field emission display as claimed in claim 1, wherein a diameter of each one of the at least two CNT string is in a range from about 1 micrometer to about 100 micrometers, and a length of each one of the at least two CNT strings is in a range from about 0.1 centimeters to about 10 centimeters.

4. The color pixel element for field emission display as claimed in claim 1, wherein the plurality of first CNT bundles and the plurality of second CNT bundles are closely packed, and each one of the plurality of first CNT bundles and the plurality of second CNT bundles comprises a plurality of CNTs substantially parallel to each other and joined by van der Waals attractive force.

5. The color pixel element for field emission display as claimed in claim 4, wherein the CNTs at the emission portion have a diameter less than 5 nanometers and a number of graphite layers in a range from about 2 to about 3.

6. The color pixel element for field emission display as claimed in claim 4, wherein the CNTs in a portion of the at least two CNT strings other than the emission portion have a diameter of about 15 nanometers and a number of graphite layers more than 5.

7. The color pixel element for field emission display as claimed in claim 1, further comprising at least two anode terminals and a cathode terminal, wherein each one of the at least two anode terminals is electrically connected to a corresponding anode, and the cathode terminal is electrically connected to the cathode.

8. The color pixel element for field emission display as claimed in claim 7, wherein the at least two anode terminals and the cathode terminal run from inside of the sealed container to outside of the sealed container.

9. The color pixel element for field emission display as claimed in claim 7, wherein the cathode, the at least two anodes, the cathode terminal and the at least two anode terminals are made of thermally and electrically conductive materials.

10. The color pixel element for field emission display as claimed in claim 9, wherein the at least two anodes are made of metal materials, and the end surfaces of the at least two anodes are polished metal surfaces or plated metal surfaces.

11. The color pixel element for field emission display as claimed in claim 1, wherein the sealed container is a hollow member that defines an inner space in vacuum.

12. The color pixel element for field emission display as claimed in claim 1, wherein the sealed container is a hollow cube; a side length of the sealed container is in a range from about 2 millimeters to about 10 millimeters.

13. The color pixel element for field emission display as claimed in claim 1, wherein the light permeable portion has a surface selected from the group consisting of a plane surface, a spherical surface, and an aspherical surface.

14. The color pixel element for field emission display as claimed in claim 1, wherein the at least two CNT strings are electrically connected to and contacting the cathode by conductive paste.

15. The color pixel element for field emission display as claimed in claim 1, wherein the emission portion of each one of the at least two CNT strings is suspended.

16. The color pixel element for field emission display as claimed in claim 1, wherein a distance between the emission portion of each one of the at least two CNT strings and the corresponding phosphor layer is less than 5 millimeters.

17. The color pixel element for field emission display as claimed in claim 1, wherein the emission portion of each one of the at least two CNT strings is arranged parallel to a surface of the corresponding phosphor layer and a surface of the light permeable portion.

18. The color pixel element for field emission display as claimed in claim 1, wherein distances between the cathode and each one of the at least two anodes are substantially equal, and distances among adjacent anodes are substantially equal.

19. A color pixel element for field emission display, the color pixel element comprising:

a sealed container having a light permeable portion;

a cathode;

at least two anodes;

at least two phosphor layers, wherein each one of the at least two phosphor layers is formed on an end surface of a corresponding anode and spaced from the light permeable portion; and at least two cathode emitters electrically connected to and contacting the cathode, wherein each one of the at least two cathode emitters is parallel to a surface of the corresponding phosphor layer and a surface of the light permeable portion and has an emission portion located between a corresponding phosphor layer and the light permeable portion;

wherein the cathode, the at least two anodes, the at least two phosphor layers, and the at least two cathode emitters are enclosed in the sealed container.

* * * * *